United States Patent [19]

Gardell et al.

[11] 4,004,650

[45] Jan. 25, 1977

[54] SILENCERS

[75] Inventors: Lars Johan Gardell, Enhorna; Bertil Lennart Wilhelmsson, Alvsjo, both of Sweden

[73] Assignee: Saab-Scania Aktiebolag, Sodertalje, Sweden

[22] Filed: Dec. 29, 1975

[21] Appl. No.: 644,548

[52] U.S. Cl. ..... 181/42; 181/47 R; 181/48

[51] Int. Cl.[2] ..... F01N 1/04

[58] Field of Search ..... 181/42, 47 R, 48, 69

[56] References Cited

UNITED STATES PATENTS

| | | | |
|---|---|---|---|
| 1,938,973 | 12/1933 | Oldberg | 181/48 |
| 1,975,861 | 10/1934 | Oldberg | 181/48 |
| 2,401,570 | 6/1946 | Koehler | 181/47 R |
| 2,937,707 | 5/1960 | Ernst | 181/42 |

*Primary Examiner*—Stephen J. Tomsky
*Attorney, Agent, or Firm*—Schiller & Pandiscio

[57] ABSTRACT

The invention relates to silencers for damping sound waves created in gases, comprising a series of thin-walled, tubular damping units and an inner tube for conducting gases through the end walls of the units, the tube having openings communicating with the chambers defined in each unit. In accordance with the invention each damping unit is surrounded by an outer tube which is connected in a gas-tight fashion through two end walls with the cylindrical surface of the damping unit, and the space between the cylindrical surface and the outer tube is divided into at least two chambers communicating with the inner tube through a transversely-extending branch pipe.

6 Claims, 3 Drawing Figures

SILENCERS

The present invention relates to a silencer for damping sound waves created by gases, such as the exhaust gases of internal combustion engines, said silencer comprising a group of at least two straight damping units which are arranged in series and each of which comprises a tubular body of thin-wall construction having two end walls, and further comprising an inner tube which is adapted to conduct the gases passing through said walls, said inner tube being secured in a gas-tight fashion and enclosing between said walls a ring-shaped chamber between the inner tube and the cylindrical surface of the tubular body, said inner tube being provided with a member of openings arranged to communicate with said chamber, a sound-absorbing material being arranged in at least part thereof.

By the correct selection of the dimensions, such a silencer can be tuned with respect to sound so that the chamber functions both as an expansion chamber and as a resonator. This affords important advantages with respect to the provision of a low pressure drop and small space requirements for the silencer. A silencer constructed of a plurality of damping units can be designed to dampen sound within a broad frequency range, although with large internal combustion engine, such tuning of the silencer is not sufficient to effectively dampen the occurring sound effects, particularly within the lower frequency range.

An object of the present invention is to at least substantially eliminate the disadvantages and relates to a silencer which, in addition to a group of straight damping units, also includes a further group of damping units which enables damping to be effected within a broader frequency range, the invention being mainly characterised by the fact that at least one damping unit is enclosed in an outer tube having two end walls which are connected in a gas-tight fashion with the cylindrical surface of the damping unit, and in that the space between the cylindrical surface and the outer tube is divided into at least two chambers, each of which is arranged to communicate with the inner tube in the damping unit through at least one transverse branch pipe.

In accordance with a preferred embodiment, the silencer comprises three concentric tubes which form, together with intermediate walls and end walls, a number of damping units, the chambers between the inner tube and the intermediate tube being provided with sound-absorbing material whilst the chambers between the intermediate tube and the outer tube have no such absorbent material arranged therein. The chambers which have no absorbent material arranged therein and which are disposed between the intermediate tube and the outer tube are separated from each other by radial inner walls extending longitudinally between the walls of the outer tube. In this way there is obtained a large chamber volume for the damping of the exhaust gases of large combustion engins, communication of the chamber with the inner tube through which the gases are conducted can be effected without disturbingly influencing the function of the other damping units.

So that the inventions will be more readily understood and further features thereof made apparent, embodiments of the invention will now be described with reference to the accompanying drawing in which.

Figure 1:
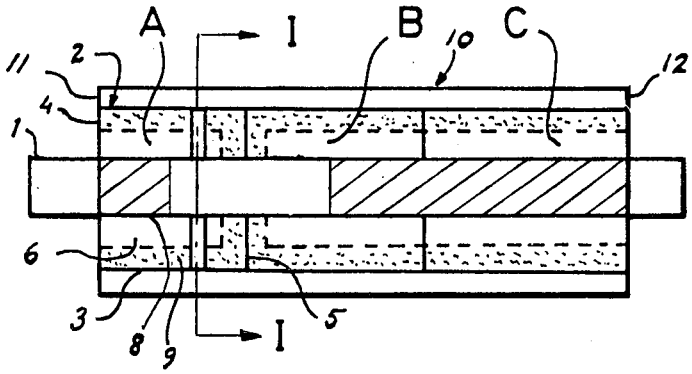
FIG. 1 shows diagrammatically a silencer according to the invention comprising five damping units.

In FIG. 1 there is shown a group of three damping units A, B, C of similar construction, and hence the following description will be made with reference to only one of these units. A tube 1 of circular cross-section is arranged to conduct waste gases from a combustion motor (not shown). The tube 1, which hereinafter is referred to as the inner tube, is surrounded by a cylinder 2 which is concentric therewith, the cylinder 2 hereinafter being referred to as the intermediate tube whose ends are sealed in a gastight fashion to the cylindrical surface 3 of the intermediate tube and to the inner tube 1 which is provided with planar end walls 4, 5. Enclosed between the cylindrical surface 3 of the intermediate tube, the end walls 4, 5 and the inner tube 1 is an annular chamber 6. The volume of gas enclosed in the chamber 6 is intended to communicate with the waste gases in the inner tube 1 through a number of circular holes 7. With the illustrated embodiment the end walls of the damping unit B are common to the inner side walls of the damping units A and C, and the cylindrical intermediate tube 2 is common to the three damping units A, B, C. The inner cylindrical surface of the intermediate tube 2 of the damping units A, B, C and one end wall of the damping units A and B are covered with a sound-absorbing material 9 which is held in place by a net-structure (not shown). The purpose of the absorbent material is to dampen acoustic radiation and to eliminate resonance phenomenon. With the exemplified embodiment of the silencer, the absorbent material adopts a protected position and also dampens vibrations of the intermediate tube 2.

In the damping units A and B, the inner tube 1 is perforated with holes 7 along only a portion 8 of its axial length. This perforated length 8 is, in FIG. 1, sectioned and comprises at least 50 % of the axial extension of the tube 1 in respective damping units A and B. The holes 7 are uniformly spaced in a circular transverse plane around the inner tube 1 and with the illustrated embodiment sixteen holes are arranged in each dividing plane, the distance between the dividing planes being equal to twice the diameter of the holes.

The damping units A and B are of similar construction, but with respective perforations in mutually opposing ends. The imperforate portions of the inner tube 1 of the damping units A and B can be said to constitute a so-called double-expansion chamber having an internal connection tube of chamber length. In damping unit C, the inner tube 1 is perforated along the whole of its length.

With the illustrated embodiment of FIG. 1, both the inner tube 1 and the intermediate tube 2 are common to the three damping units A, B, C. In FIG. 1, the intermediate tube 2 is shown to be surrounded along the whole of its length by an outer tube 10 which is concentric with said inner tube. The outer tube 10, however, need not necessarily extend the whole length of the intermediate tube 2. The outer tube 10 is connected to the intermediate tube 2 in a gas-tight fashion through planar end walls 11, 12. The ring-shaped chamber formed between the outer tube 10 and the intermediate tube 2 is divided into two chambers 13, 14 which are separated from each other in a gas-tight manner and each of which is arranged to be connected with the inner tube passing through the silencer via a transverse branch pipe 15, 16. The chambers 13, 14 are separated from each other by means of two radial inner walls 17, 18 which extend longitudinally between the end walls 11, 12 of the outer tube 10 and the positioning of which is dependent upon the desired chamber volume. By providing the walls 17, 18 separating the chambers 13, 14 with a longitudinal extension, it is possible to obtain a longitudinally tight connection of the branch pipes 15, 16 to the inner tube 1 passing through the silencer. Connection of the silencer. Connection of the branch pipes 15, 16 to the inner tube 1 should suitably be effected at an imperforate portion whereof, so as not to disturb the function of the damping units A, B, C. Furthermore, it is an advantage to connect the branch pipes 15, 16 adjacent the inlet end of the silencer, at which the pressure of the waste gases is greatest.

The chambers 13, 14 and respective branch pipes 15, 16, form a second group of damping units D, E, the damping ability of which greatly depends on the dimensions of the branch pipes 15, 16 and the through-flow area and length thereof, as well as the volume of the chambers 13, 14 cooperating with said branch pipes. As a result of this selective positioning of the chambers 13, 14, protrusion of the branch pipes 15, 16 into the inner tube 1 is eliminated or at least restricted when using the branch pipe dimensions relevant when damping the exhaust gas sound of large combustion engines. In this way disturbances to the flow through the inner tube as a result of such protrusion is avoided.

Figure 2:
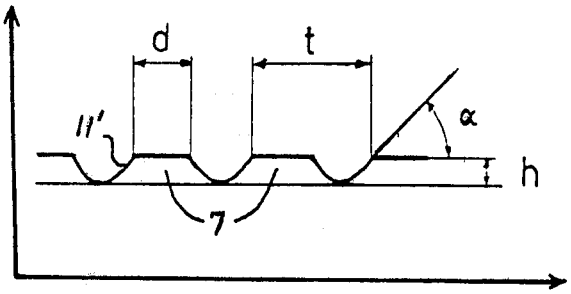
FIG. 2 is a diagrammatic longitudinal sectional view through the centre of the inner tube.
Figure 3:
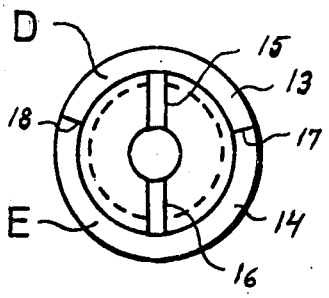
FIG. 3 is a diagrammatic cross-section view waken on the line I—I of FIG. 1.

As will be seen from FIG. 2, each hole 7 in the inner tube 1 is fenced-in by an outwardly-extending collar 11'. The transverse flank of the collar 11' is inclined at an angle $\alpha$ in relation to the longitudinal axis of the tube 1. To provide a good damping effect, the angle $\alpha$ should be between 35° and 45° and the ratio between the height $h$ of the collar 11' and the diameter $d$ of the hole 7 should, for the same purpose, exceed a certain minimum value which can vary depending upon the frequency range of the sound to be damped. With the illustrated silencer, this ratio is selected between 0.4 and 0.5. The ratio may also be expressed as an angle which gives the free-radiation angle which the progagation direction of a sound wave must present to the cylindrical surface of the inner tube in order that the sound wave can be delivered.

By perforating the inner tube 1 with collar-surrounded holes 7 in accordance with the above, there is obtained from an aerodynamic aspect an advantageous flow of gas with small pressure losses. Gas flow against sharp edges gives rise to eddy currents and therewith low-frequency pressure pulses. This type of flow generation is avoided by the gentle transition surfaces and the large radii of curvature present in the flow-path of the gas. The position of collars around the holes is also favourable from the aspect of vibration since such an arrangement eliminates the form of noise generation which occurs when the gas-flows repeatedly collide with the sharp edges of consecutively arranged holes not provided with such collars.

The question of how large a portion of the surface of the inner tube shall be perforated, i.e. the so-called degree of perforation, is decided by the pressure of the sound to be dampened. The optimum degree of perforation falls with a falling sound pressure and in the case of large diesel engines for motor vehicles, a perforation degree of 30 % has been found suitable.

To obtain the best possible damping effect, it should be attempted to displace the rows of holes in a manner such that all angular portions of the periphery of the inner tube as seen in the axial direction exhibit holes 7. With one advantageous embodiment, perforation of the inner tube has been effected so that adjacent holes having a division $t$ in two division planes form the corner points of isosceles triangles, thereby providing a larger coverage of the periphery of the inner tube as seen in the axial direction.

Expressed in the terminology used in silencer techniques, the damping units A, B, C exhibit a combined resistive and reactive function. The resistive function is obtained partly by the provision of sound-absorbing material on the inner walls of the intermediate tube 2 and partly resistive damping is obtained with the pressure pulses through the collar-surrounded holes 7 owing to the degree of perforation in relation to sound pressure. Since the inner cylindrical surface of the intermediate tube 2 and one inner wall surface of the damping units A and B are provided with sound-absorbing material, both transverse and axial sound waves will be subjected to absorption. Only a certain portion, however, of the sound waves impinging on the walls will be absorbed. This portion, however, is greater for high-frequency sound than for low-frequency sound. The walls coated with absorbent material are therefore mainly to dampen the high-frequency sound waves. In addition, the absorbent material provides reinforcement of the intermediate tube which reduces the sound radiation from the cylindrical surface and which favourably affects the useful life of the silencer. The absorbent material may comprise fibre-cloth, for example, porous, non-fibre stone wool packed to a density of at least 150 kg/m$^3$. The absorbent material may also comprise other sound-damping structures known in connection with sound-damping arrangements in jet engines.

The reactive function of the damping units A, B, C is obtained by the fact that respective chambers 6 function as a so-called expansion chamber and as a so-called resonator, this latter function being achieved in cooperation with the holes 7 on the inner tube 1.

Damping of the expansion chamber in accordance with known technique exhibits a so-called pass-band characteristic, i.e. a very low degree of damping is obtained at certain frequencies depending upon the arrival of standing waves between the defining surfaces of the chamber 6. Damping reaches a maximum between these frequencies. The axial extension of the chamber 6 decides where these low-damping frequencies occur, while the transverse dimensions of the chamber 6 determine the maximum strength of the damping.

The damping characteristic of the resonator is characterised by the fact that damping reaches a high maximum value at a resonance frequency and that it diminishes on either side of this frequency. Where the resonance frequency falls is decided primarily by the relationship between the dimensions of the holes and the volume of the chamber.

The damping units A, B, C should be dimensioned so that the damping characteristics of the expansion chamber and the resonator are tuned in respect to each other. The damping maximum of the resonator should thus lie at the frequency at which the lowest degree of damping of the waste-gas sound is obtained in the expansion chamber. Further, this damping maximum is assigned the frequency at which the waste-gas sound in question exhibits its noise peak. Since the sound of exhaust gas on an internal combustion engine often presents several noise peaks, it is as a rule necessary to provide the silencer with a plurality of damping units, each of said units being tuned to specific portions of the frequency range. With the illustrated embodiment of FIG. 1, the damping units A, B, C are arranged sequentially in series, said units being housed in a common housing 3.

The damping units D, E have the form of Helmholtz-resonators, known in the silencer technique, which, as the name discloses, have a pure resonator function. The strength of the dampening at the resonance frequency and adjacent frequencies thereto increases with the dimensions of the chamber 13, 14 and in particular the branch pipe 15, 16. As a result of the illustrated positioning of the chambers 13, 14 in the damping units D and E, the dimensions of the branch pipes 15, 16 can be selected within wide limits without the connection of the branch pipes to the inner tube 1 disturbing the function of the damping units A, B, C. The damping units D, E are conveniently tuned for effective damping of noise peaks within the lower frequency range where the damping afforded by the damping units A, B, C is not sufficient.

The described and illustrated silencer can be modified in many ways within the scope of the inventive idea. Thus, the silencer need not have a circular cross-sectional shape, but may be given an elliptic cross-sectional shape or any other suitable cross-sectional shape. The tubes and chambers may be provided with walls which form any suitable cross-sectional shape, and the thickness of the absorbent material 9 in the chamber 6 between the inner tube 1 and the intermediate tube 2 may vary in different portions of the silencer, so as to increase the frequency range for maximum damping. Further, the holes 7 in the inner tube 1 may have any suitable shape and may be provided in any suitable number, and it also lies within the scope of the invention to vary the degree of perforations, the positioning, size and distribution between said openings, and also that the shape of the collars surrounding the openings 7 may be varied. Neither need the chambers 13, 14 between the intermediate tube 2 and the outer tube 10 have longitudinally-extending delimiting walls, since the chambers may be delimited by transverse partitions, the branch pipes 15, 16 from respective chambers 13, 14 to the inner tube 1 having, however, different positions in the axial direction.

We claim:

1. A silencer for damping sound waves created in gases, said silencer comprising a group of at least two straight damping units arranged in series, each of which damping units comprises a tubular body of thin-wall construction and two end walls, and an inner tube for conducting gases through said walls, said inner tube being attached in a gas-tight fashion and between the walls enclosing a ring-shaped chamber between the inner tube and the cylindrical surface of the tubular body, the inner tube being provided with a number of openings arranged to communicate with said chamber which is at least partially provided with sound-absorbing material, characterised in that at least one damping unit is surrounded by an outer tube which is connected in a gas-tight fashion through two end walls with the cylindrical surface of the damping unit, and in that the space between the cylindrical surface and the outer tube is divided into at least two chambers each of which is arranged to communicate with the inner tube through at least one transversely-extending branch pipe.

2. A silencer according to claim 1, characterised in that the silencer comprises three concentrically-arranged pipes which together with partition walls and end walls form a number of damping units, the chambers between the inner tube and the intermediate tube being provided with sound-absorbing material whilst the chambers formed between the intermediate tube and the outer tube have no such absorbent material.

3. A silencer according to claim 2, characterised in that the chambers between the intermediate tube and the outer tube are delimited from each other by radial inner walls which extend longitudinally between the end walls of the outer tube.

4. A silencer according to claim 3, characterised in that the silencer comprises a first group of three damping units arranged in series which are individually tuned for different frequency ranges, and a second group of two damping units which are arranged radially outwardly of the first group and which are individually tuned for particularly the low-frequency ranges.

5. A silencer according to claim 4, characterised in that the branch pipes extending from the chambers to the inner tube pass in a gas-sealed manner through the chamber of the damping unit closest to the inlet of the silencer.

6. A silencer according to claim 5, characterised in that the branch pipes are attached to the non-perforated portion of the inner tube.

* * * * *